US011454900B2

(12) United States Patent
Zhou

(10) Patent No.: US 11,454,900 B2
(45) Date of Patent: Sep. 27, 2022

(54) DEVELOPING CARTRIDGE

(71) Applicant: Zhuhai Dinglong Huitong Print Technology Co., Ltd, Guangdong (CN)

(72) Inventor: Honghui Zhou, Guangdong (CN)

(73) Assignee: Zhuhai Dinglong Huitong Print Technology Co., Ltd, Zhuhai (CN)

( * ) Notice: Subject to any disclaimer, the term of this patent is extended or adjusted under 35 U.S.C. 154(b) by 0 days.

(21) Appl. No.: 17/482,469

(22) Filed: Sep. 23, 2021

(65) Prior Publication Data

US 2022/0100121 A1 Mar. 31, 2022

(30) Foreign Application Priority Data

Sep. 26, 2020 (CN) ..... 202011028233.4

(51) Int. Cl.
*G03G 15/08* (2006.01)

(52) U.S. Cl.
CPC ..... *G03G 15/087* (2013.01); *G03G 15/0808* (2013.01)

(58) Field of Classification Search
CPC ..... G03G 15/087; G03G 15/0808
See application file for complete search history.

(56) References Cited

FOREIGN PATENT DOCUMENTS

JP 2015114461 A * 6/2015 ..... G03G 21/186

* cited by examiner

*Primary Examiner* — Sevan A Aydin
(74) *Attorney, Agent, or Firm* — Gang Yu

(57) ABSTRACT

An embodiment of the present disclosure provides a developing cartridge, including: a developing cartridge frame having an internal space for accommodating a developing agent; a developing roller rotatably mounted on the developing cartridge frame and configured to supply the developing agent to a photosensitive drum; a drive end cover mounted on a drive end of the developing cartridge frame; and a drive force receiving member rotatably mounted on a drive end of the developing cartridge frame; where the drive force receiving member includes a drive force receiving part that extends out of the drive end cover and receives a rotational drive force. A driving end separation force receiving member is provided on an outer circumference of the drive force receiving part. The driving end separation force receiving member is configured to receive a separating force that separates the developing roller from the photosensitive drum.

15 Claims, 7 Drawing Sheets

DEVELOPING CARTRIDGE

TECHNICAL FIELD

The present disclosure relates to a developing cartridge for an electrophotographic imaging apparatus.

BACKGROUND

In an electrophotographic imaging apparatus such as a laser printer, a copier, a facsimile machine, or the like, a processing cartridge is usually provided and can generally be detached from the electrophotographic imaging apparatus. A processing cartridge mainly includes an integrated processing cartridge that integrates a photosensitive drum cartridge and a developing cartridge, and a separate processing cartridge in which the photosensitive drum cartridge and the developing cartridge are relatively independently arranged.

The photosensitive drum cartridge has a rotatable photosensitive drum, and the developing cartridge has a rotatable developing roller. During an imaging operation, an electrostatic latent image is formed on the photosensitive drum. The developing roller keeps pressing on the photosensitive drum to provide a developing agent (a toner) for the photosensitive drum to develop the electrostatic latent image on the photosensitive drum, and then transfer-print the developing agent on a photosensitive component to a medium such as paper to form a visible image.

However, during a non-imaging operation, if the developing roller keeps in contact with a surface of the photosensitive drum for a long time, many unfavorable consequences are provided. For example, if the developing roller keeps in contact with the photosensitive drum during the non-imaging operation, the developing roller may attach an excess developing agent to the surface of the photosensitive drum. If the photosensitive drum and the developing roller still rotate and rub in contact with each other, a premature degradation of the photosensitive drum, the developing roller and the developing agent may be provided. In particular, if the developing roller with an elastic layer is used, the elastic layer of the developing roller may be permanently deformed when being kept in contact with the photosensitive drum for a long time, and the latent image on the photosensitive drum may be developed unevenly after long-term use.

In order to solve the forgoing problems, the art known to inventors proposes a developing cartridge, which is detachably mounted on the photosensitive drum cartridge to form a separate process cartridge, and then mounted on the electrophotographic imaging apparatus. Two longitudinal ends of the developing cartridge (two ends along an axial direction of the developing roller) have a drive end cover and a detecting end cover, respectively. The drive end cover and the detecting end cover are provided with a separating force receiving part integrally formed therewith. The separating force receiving part can cooperate with a separating force transmitting member on the photosensitive drum cartridge. During the non-imaging operation (such as during cleaning of the photosensitive drum), the separating force transmitting member on the photosensitive drum cartridge transmits the separating force of the electrophotographic imaging apparatus to the separating force receiving part to separate the developing roller from the photosensitive drum. When the separating force disappears, an elastic urging member on the photosensitive drum cartridge applies a force toward the photosensitive drum to the developing cartridge, and the developing roller and the photosensitive drum contact again.

Generally, a surface of the photosensitive drum needs to be cleaned frequently between imaging operations, and the developing roller and the photosensitive drum are separated during a cleaning operation. That is to say, the developing roller and the photosensitive drum need to be frequently switched between a separated state and a contact state. Therefore, the separating force receiving part has a very high reliability. However, in the forgoing developing cartridge, on the one hand, limited by a volume and a structure of the drive end cover, the separating force receiving part provided on the drive end cover has a relatively small force-receiving area. A contact position of the separating force receiving part and the separating force transmitting part remain substantially unchanged, which causes the separating force receiving part to be easily worn or deformed after long-term use. On the other hand, the drive end cover is generally fixedly mounted on the developing cartridge frame by a screw. A mounting process is manual mounting. A problem that the screw is not firm due to human reasons when the screw is mounted is provided, which causes the drive end cover to loosen result in an uneven force under a condition of movement by frequent stress, which affects a separating effect.

SUMMARY

An embodiment of the present disclosure provides a developing cartridge, including:

- a developing cartridge frame, having an internal space for accommodating a developing agent;
- a developing roller, rotatably mounted on the developing cartridge frame, and configured to provide the developing agent for a photosensitive drum;
- a drive end cover, mounted on a drive end of the developing cartridge frame; and
- a drive force receiving member, rotatably mounted at the drive end of the developing cartridge frame;
- the drive force receiving member includes a drive force receiving part that extends out of the drive end cover and receives a rotational drive force. A driving end separation force receiving member is provided on an outer circumference of the drive force receiving part. The driving end separation force receiving member is configured to receive a separating force that separates the developing roller from the photosensitive drum.

In some embodiments of the present disclosure, the driving end separation force receiving member is provided on an outer periphery of the drive force receiving part. Since the drive force receiving part receives a rotational drive force from an electrophotographic imaging apparatus during an imaging operation, the driving end separation force receiving member provided thereon can has different positions (a contact position with a separating force transmitting member on the photosensitive drum cartridge) where the separating force is received, so that a wear or a damage of the driving end separation force receiving member can be reduced. In addition, the driving end separation force receiving member is arranged on the outer periphery of the drive force receiving part. The drive force receiving part can effectively support the driving end separation force receiving member, avoiding a deformation of the driving end separation force receiving member, and having better reliability and stable separating effect under a long-term use.

In some embodiments, the driving end separation force receiving member is arranged on an outer periphery of the drive force receiving part. When the developing roller and the photosensitive drum are separated, the drive end cover does not need to bear the separating force, so the drive end cover in the art known to inventors is not easy to be loosened because the drive end cover is frequently stressed, which affects the separating effect.

In some embodiments, the driving end separation force receiving member is provided along a part or an entire outer circumference of the drive force receiving part. When the driving end separation force receiving member is only provided on a part of the outer circumference of the drive force receiving part, a position sensor for detecting the driving end separation force receiving member is configured in the electrophotographic imaging apparatus or the photosensitive drum cartridge, so as to detect and control the driving end separation force receiving member to stop within a range of a position that can receive the separating force.

In some embodiments, the driving end separation force receiving member is provided along the entire outer circumference of the drive force receiving part. In this way, during a non-imaging operation, the driving end separation force receiving member stops at any position, and the separating force can be received.

In some embodiments, the driving end separation force receiving member as a whole has a circumferential surface arranged coaxially with the drive force receiving part. In this way, if the driving end separation force receiving member stops at any position, the driving end separation force receiving member can have substantially the same separating effect. A circumferential surface of the driving end separation force receiving member may be a smooth surface or a non-smooth surface with a uniform concave-convex structure.

In some embodiments of the present disclosure, the driving end separation force receiving member and the drive force receiving part are formed integrally or fixedly connected.

Specifically, a detachable or non-detachable snap connection is formed between the drive force receiving part and the driving end separation force receiving member.

More specifically, the outer circumference of the drive force receiving part is provided with one or more bayonets. An inner circumference of the driving end separation force receiving member is correspondingly provided with one or more protrusions. The protrusion is engaged with the bayonet to realized the snap connection.

In some other embodiments of the present disclosure, the driving end separation force receiving member is rotatably sleeved on the outer circumference of the drive force receiving part. In this way, the driving end separation force receiving member can produce a certain degree of rotation when receiving the separating force, which is more conducive to reducing the friction force received by the separating force receiving force receiving member is rotatably sleeved on the outer circumference of the drive force receiving part. In this way, the driving end separation force receiving member can produce a certain degree of rotation when receiving a separation force, and it is benefit to reduce a friction force received by the separating force receiving member.

Specifically, a sliding groove is provided on the outer circumference of the drive force receiving part. A flange is correspondingly provided on an inner circumference of the separating force receiving member. The flange is rotatably arranged in the sliding groove. The flange can be provided along the entire inner circumference of the separating force receiving member, or can be formed only on a part of the inner circumference of the separating force receiving member.

More specifically, the drive force receiving part includes a main body part and a distal end part. The driving end separation force receiving member is sleeved on a step-section of an axial outer end of the main body part. The distal end part is provided in the axial direction of the flange. The distal end part is fixedly connected with an axial outer end of the main body to form the sliding groove.

In some embodiments of the present disclosure, the driving end separation force receiving member can protrude from the drive force receiving part in an axial direction of the drive force receiving member, so that the drive force receiving part is properly protected.

In order to more clearly illustrate the objectives, technical solutions and advantages of the present disclosure, the present disclosure is further described in detail below with reference to the drawings and specific embodiments.

DETAILED DESCRIPTION OF THE EMBODIMENTS

Figure 1:
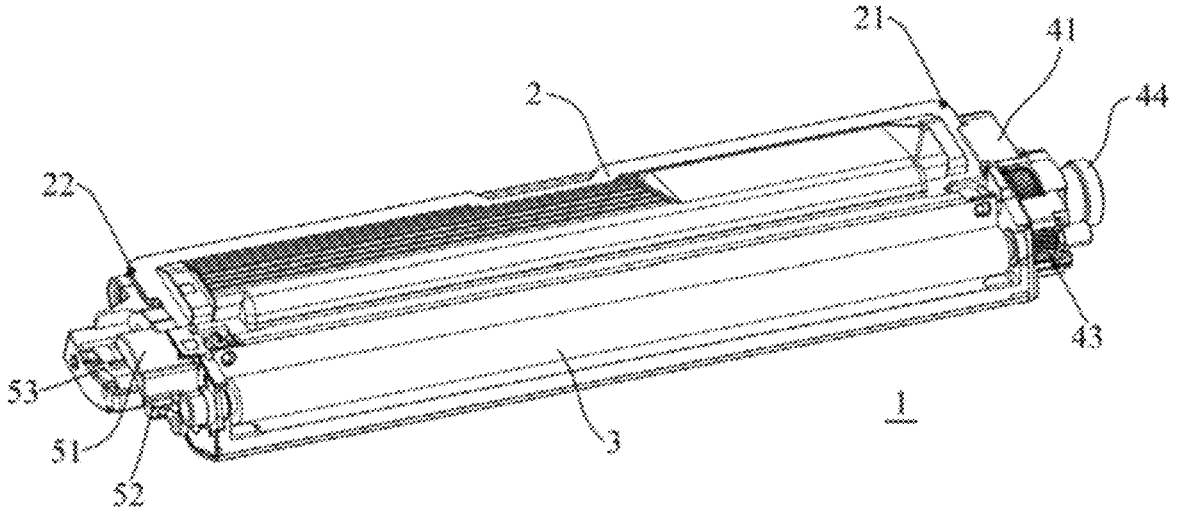
FIG. 1 is a first perspective view of an embodiment of a developing cartridge of the present disclosure.
Figure 2:
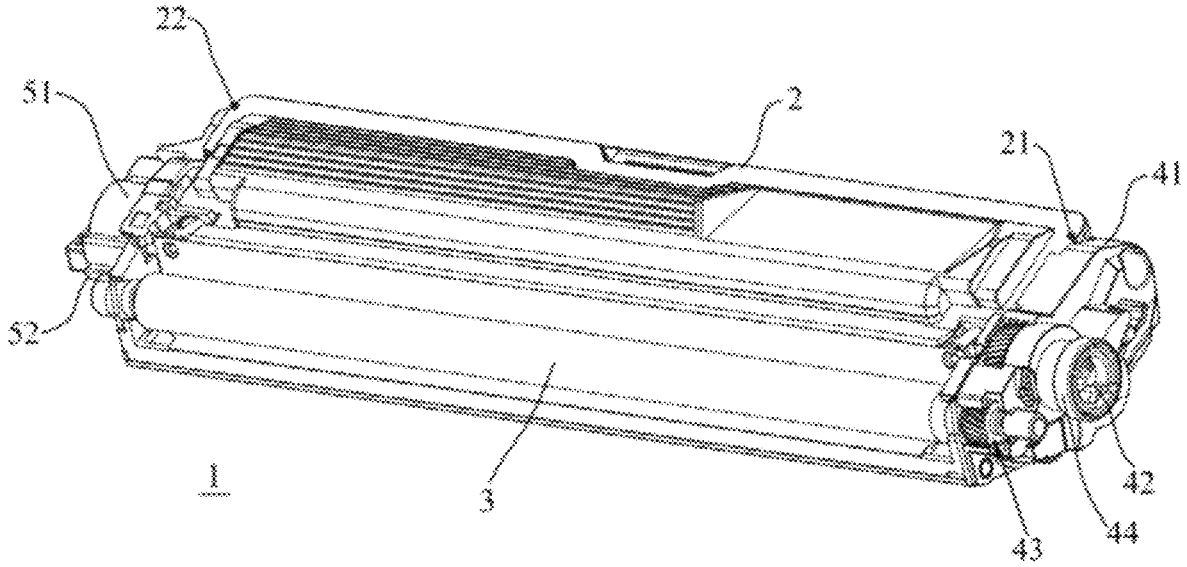
FIG. 2 is a second perspective view of an embodiment of a developing cartridge of the present disclosure.

FIGS. 1 and 2 show an overall structure of a developing cartridge 1 in an embodiment of the present disclosure. As shown in FIGS. 1 and 2, the developing cartridge 1 includes a developing cartridge frame 2 and a developing roller 3 rotatably mounted on the developing cartridge frame 2. The developing cartridge frame 2 has an inner space for accommodating a developing agent. The inner space is provided with a stirring/conveying member for stirring and/or conveying the developing agent. The developing cartridge frame 2 is also provided with a powder feeding roller in contact with the developing roller 3. The powder feeding roller is configured to lead the developing agent to be adhered to a surface of the developing roller 3. A circumferential surface of the developing roller 3 is partially exposed to the developing cartridge frame 2, so that when the developing cartridge 1 is mounted in a photosensitive drum cartridge (not shown), the developing cartridge 1 can contact with a photosensitive drum on the photosensitive drum cartridge, and supply the developing agent to the photosensitive drum when an electrophotographic imaging apparatus performs an imaging operation.

A Structure of a Drive End of the Developing Cartridge

One of two longitudinal ends (that is, an axial direction of the developing roller 3) of the developing cartridge frame 2 is a drive end 21. A drive end cover 41, a drive force receiving member 42, a gear transmission mechanism 43, and a driving end separation force receiving member 44 are mounted at the drive end. When the developing cartridge 1 is mounted in the electrophotographic imaging apparatus, the drive force receiving member 42 can receive a rotational drive force from the electrophotographic imaging apparatus, and drive the developing roller 3 to rotate through the gear transmission mechanism 43.

Figure 3:
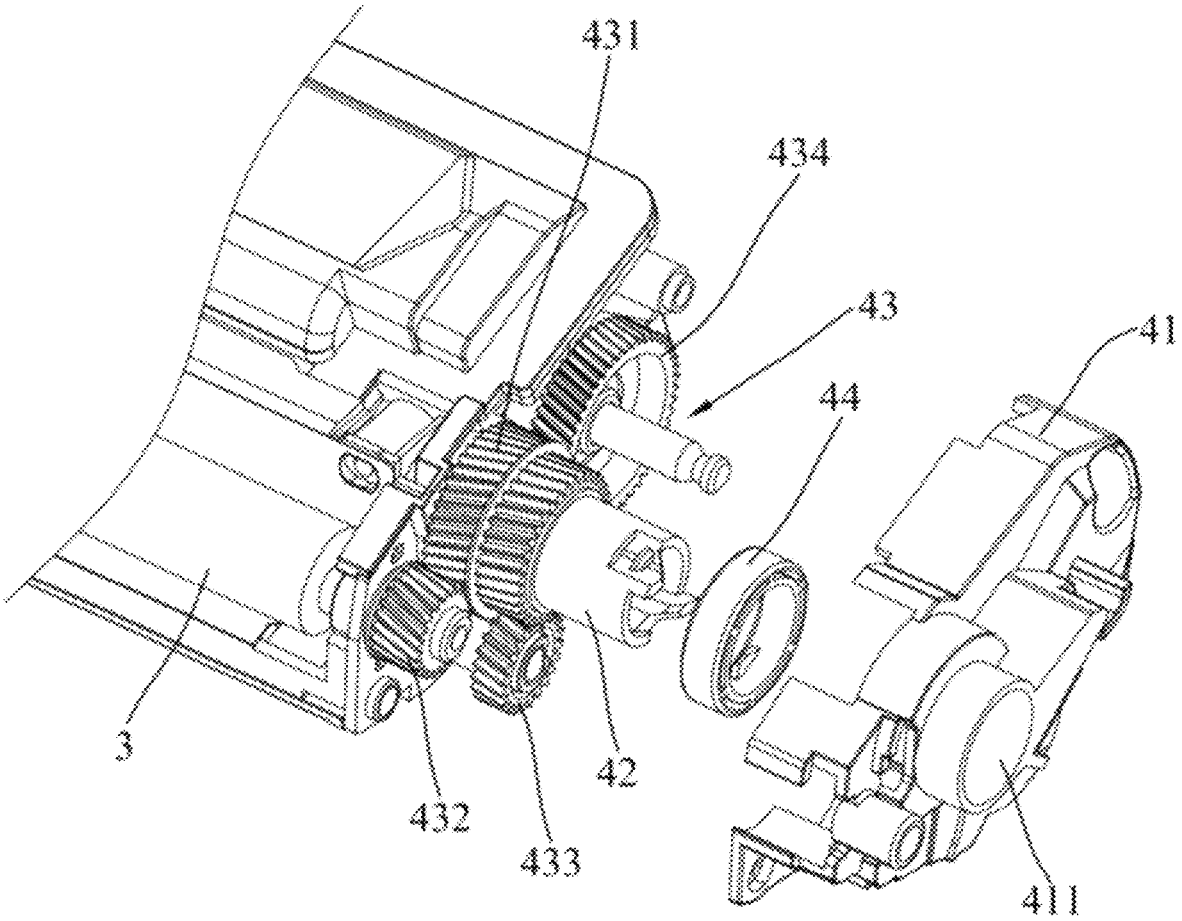
FIG. 3 is a structural exploded view of a first embodiment of a drive end of a developing cartridge of the present disclosure.

In some embodiments, as shown in FIG. 3, the gear transmission mechanism 43 includes a drive gear 431, a developing roller gear 432, a powder feeding roller gear 433, and a stirring/conveying member gear 434. The drive gear 431 and the drive force receiving member 42 are coaxially arranged and formed as one body. The developing roller gear 432, the powder feeding roller gear 433, and the stirring member gear 434 are all meshed with the drive gear 431. The drive force receiving member 42 receives the rotational drive force from the electrophotographic imaging apparatus, and drives the developing roller 3, the powder feeding roller and the stirring/conveying member to rotate through the gear transmission mechanism 43.

Figure 4:
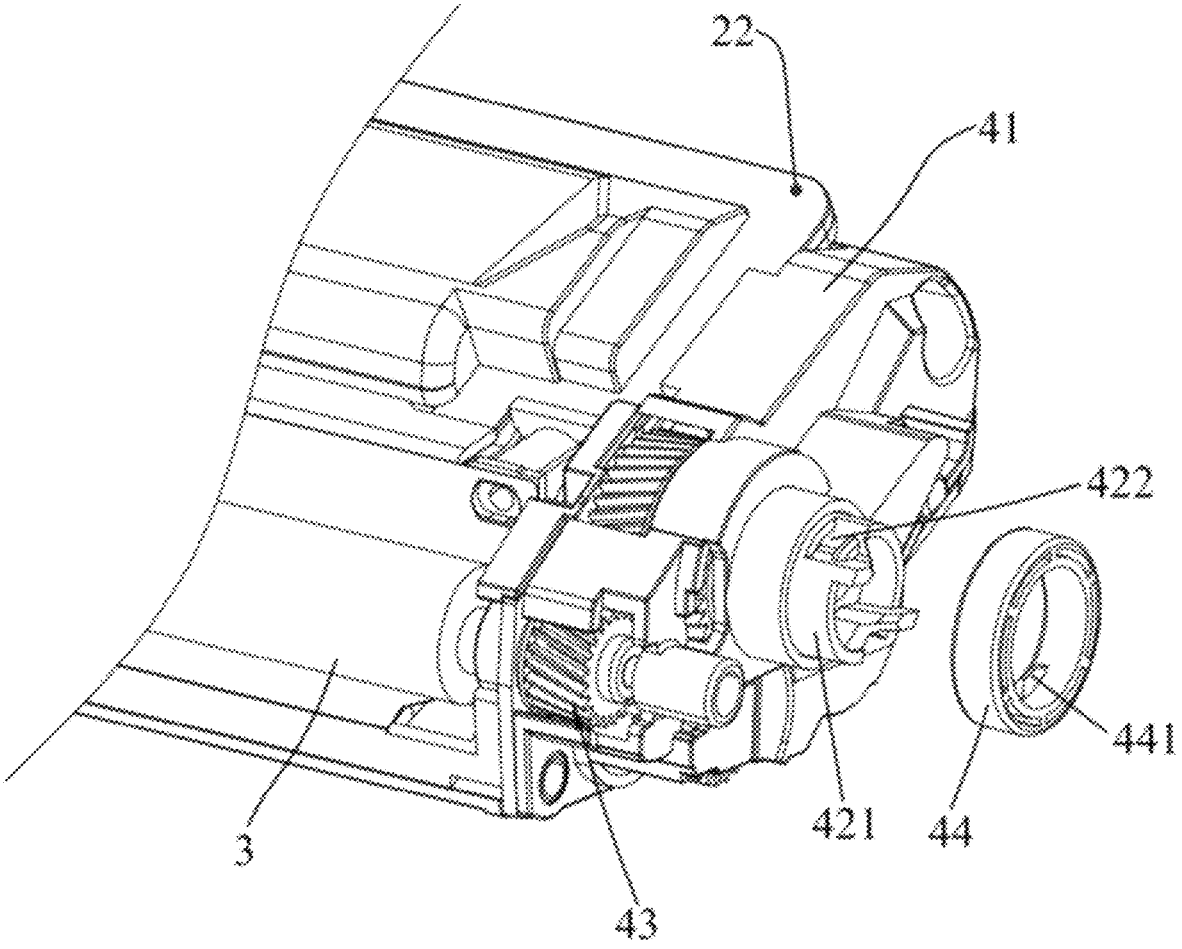
FIG. 4 is another structural exploded view of a first embodiment of a drive end of a developing cartridge of the present disclosure.

Referring to FIGS. 3 and 4, in one embodiment of the present disclosure, the drive force receiving member 42 includes a drive force receiving part 421. The drive force receiving part 421 is extended out of a hole 411 of the drive end cover 41 in a longitudinal direction of the developing cartridge 1, and further receives a rotation drive force from the electrophotographic imaging apparatus. The driving end separation force receiving member 44 is provided on an outer circumference of the drive force receiving part 421, that is, the driving end separation force receiving member 44 is positioned outside the drive end cover 41, and is configured to receive a separating force separating the developing roller 2 and the photosensitive drum from a side of the drive end 21 of the developing cartridge 1. In some embodiments, the driving end separation force receiving member 44 is provided along an entire outer circumference of the drive force receiving part 421 and has a circumferential surface provided coaxially with the drive force receiving part 421.

The drive force receiving part 421 and the driving end separation force receiving member 44 may form a fixed connection, such as a detachable or non-detachable snap connection. In the embodiment shown in FIGS. 3 and 4, the outer circumference of the drive force receiving part 421 is provided with one or more (for example, two) bayonets 422. An inner circumference of the driving end separation force receiving member 44 is correspondingly provided with one or more protrusions 441. Each of the protrusions 441 is engaged with the corresponding bayonet 422 to realize the snap connection.

Figure 5:
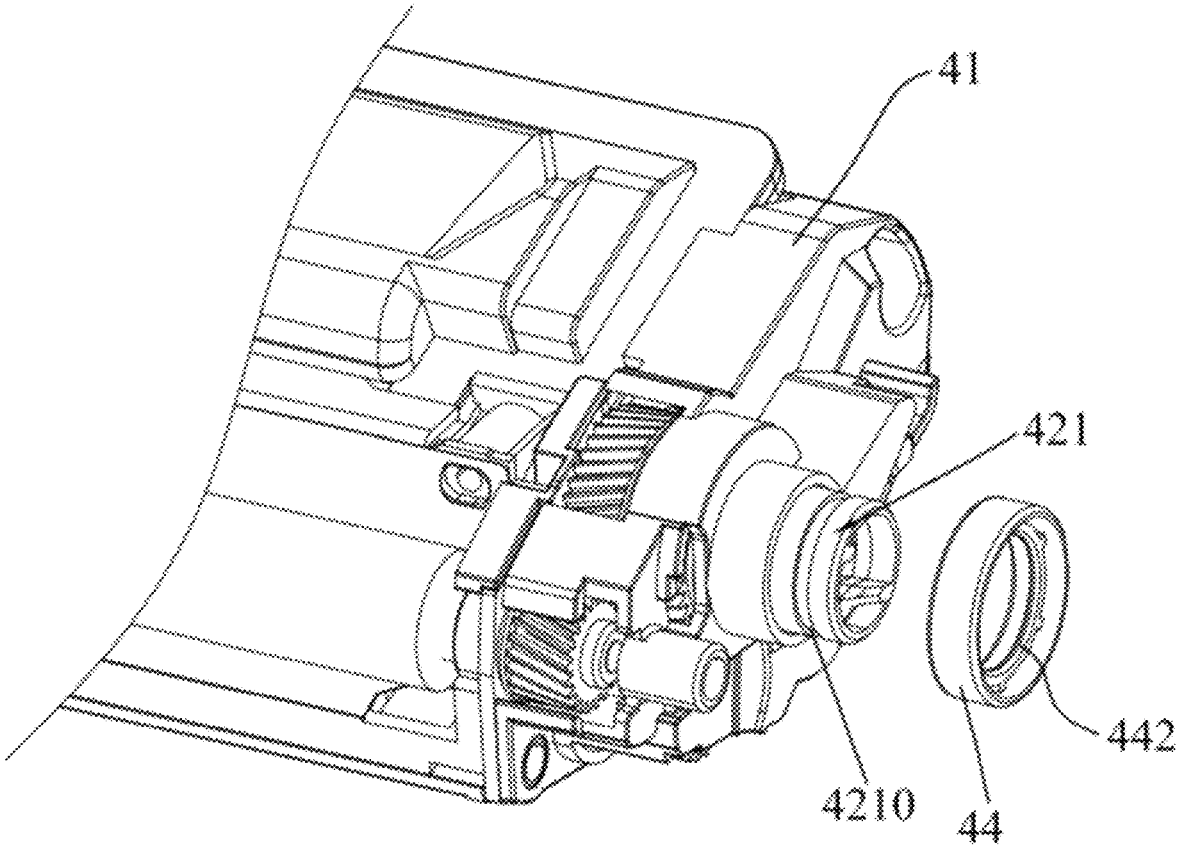
FIG. 5 is a structural exploded view of a second embodiment of a drive end of a developing cartridge of the present disclosure.

In another embodiment of the present disclosure, the driving end separation force receiving member 44 is rotatably sleeved on the outer circumference of the drive force receiving part 421. FIG. 5 shows a structure of another embodiment of the present disclosure. A sliding groove 4210 is provided on the outer circumference of the drive force receiving part 421. The driving end separation force receiving member 44 is correspondingly provided with a flange 442 in an entire inner circumference direction thereof. The flange 442 is rotatably arranged in the sliding groove 4210.

Figure 6:
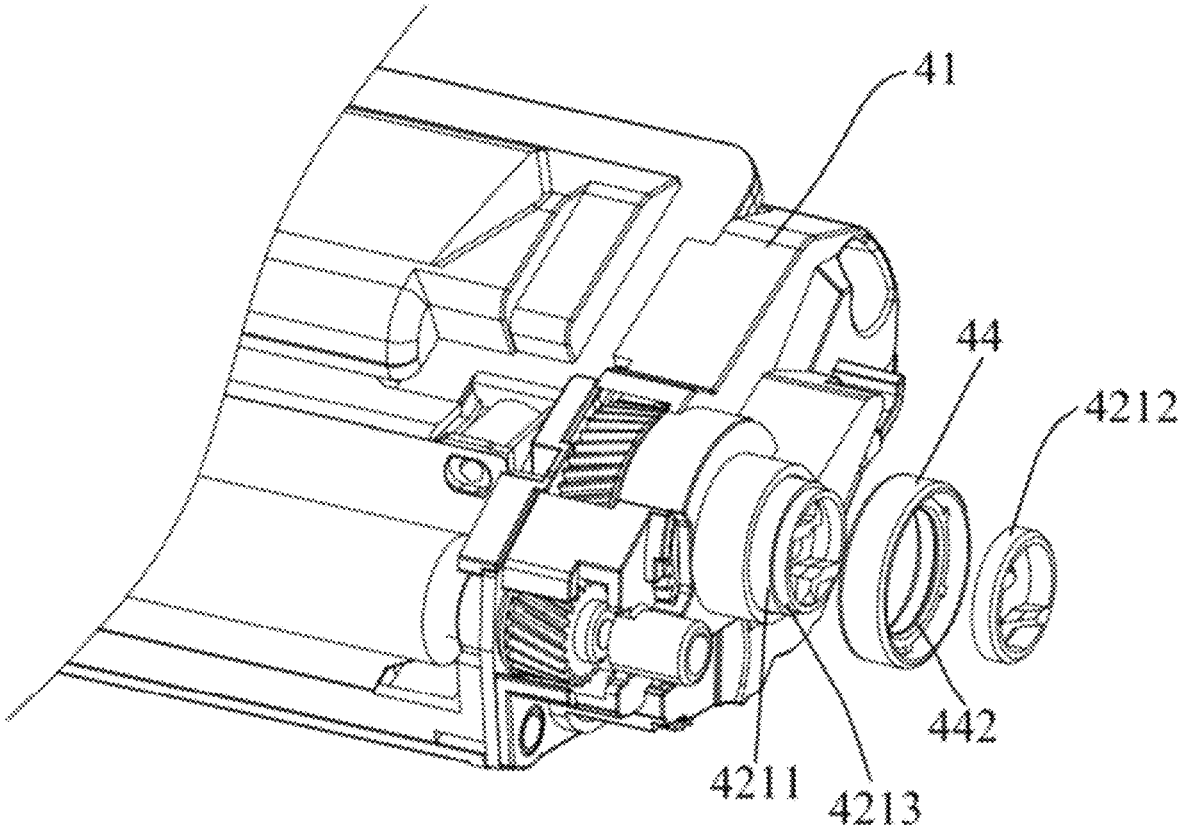
FIG. 6 is another structural exploded view of a second embodiment of a drive end of a developing cartridge of the present disclosure.

In some embodiments of the present disclosure, as shown in FIG. 6, the drive force receiving part 421 includes a main body part 4211 and an end part 4212. The driving end separation force receiving member 44 is sleeved on a stage 4213 at an axial outer end of the main body part 4211. The end part 4212 is arranged on an axial outer side of the flange 442, and is fixedly connected to the axial outer end of the main body part 4211 to form the sliding groove 4210.

In other embodiments of the present disclosure, the driving end separation force receiving member 44 is formed integrally with the drive force receiving part 421. In addition, the driving end separation force receiving member 44 can appropriately protrude from the drive force receiving part 421 in an axial direction of the drive force receiving member 42, thereby being able to protect the drive force receiving part 421 to a certain extent, for example, to prevent the drive force receiving part 42 from be damaged during transportation.

In other embodiments of the present disclosure, the driving end separation force receiving member can be provided only on a part of the outer circumference of the drive force receiving part. In this case, a position sensor for detecting the driving end separation force receiving member is arranged in the electrophotographic imaging apparatus or the photosensitive drum cartridge to detect and control the driving end separation force receiving member to stop in a range of a position that can receive the separating force.

A Structure of an Detecting End of the Developing Cartridge

Please referring to FIGS. 1 and 2 again, the other of the two longitudinal ends (i.e., the axial direction of the developing roller 3) of the developing cartridge frame 2 is a detecting end 22. The detecting end 22 is provided with a detecting end cover 51, a detecting member 53 and a detecting end separation force receiving member 52. The detecting member 53 is at least partially covered by the detecting end cover 51 in a longitudinal direction of the developing cartridge 1. Moreover, the detecting member 53 is extended or exposed to the detecting end cover 51 from an upper part of the developing cartridge 1 (referring to an orientation shown in FIG. 1). When the developing cartridge 1 is mounted in the electrophotographic imaging apparatus, the detecting member 53 is configured to be detected by the electrophotographic imaging apparatus to identify relevant information of the developing cartridge 1 (for example, an old or new developing cartridge and/or a printable quantity of the developing cartridge).

Figure 7:
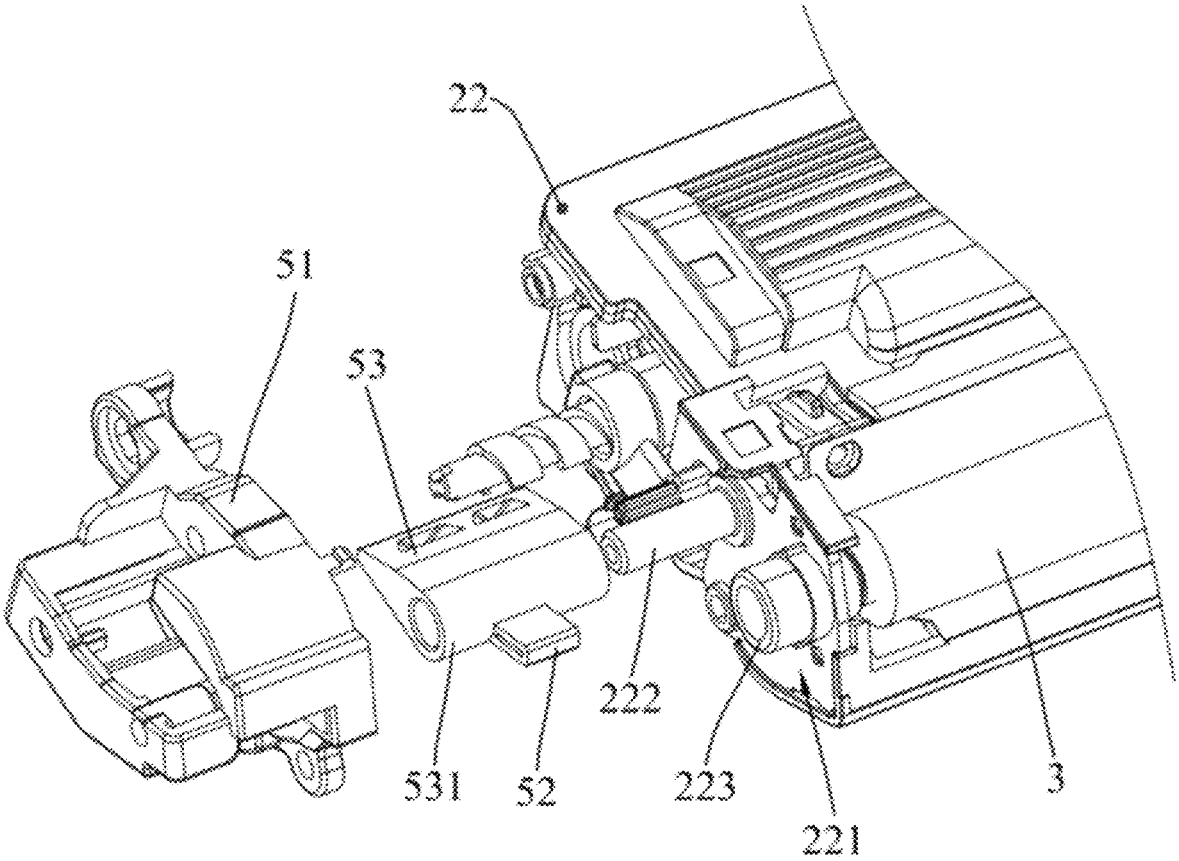
FIG. 7 is an structural exploded view of a first embodiment of a detecting end of a developing cartridge of the present disclosure.

As shown in FIG. 7, in an embodiment of the present disclosure, the detecting end 22 of the developing cartridge frame 2 is provided with a supporting column 222. A rotation shaft 531 of the detecting member 53 is rotatably mounted on the supporting column 222. The detecting end separation force receiving member 52 is arranged on the rotating shaft 531 of the detecting member 53 and is formed integrally or fixedly connected to the detecting member 53. As shown in FIGS. 1 and 2, the detecting end separation force receiving member 52 is extended out of the detecting end cover 51 toward the developing roller 3, so as to be able to receive the separating force separating the developing roller 2 from the photosensitive drum from a side of the detecting end 22 of the developing cartridge 1.

In an embodiment of the present disclosure, on the one hand, the support column 222 can effectively support the detecting end separation force receiving member 52. On the other hand, compared with a separating force receiving part provided on the detecting end cover in the art known to inventors, a size and a force-receiving area of the detecting end separation force receiving member 52 can be made larger, thereby reducing deformation and abrasion under force, and having better reliability under long-term use. Further, the detecting end separation force receiving member 52 is supported by the supporting column 222. When the developing roller 3 and the photosensitive drum are separated, the detecting end cover 51 does not need to bear the separating force, there will be no problem that the detecting end cover 51 is easy to be loosened by frequent stress.

After the developing cartridge 1 is mounted in the electrophotographic imaging apparatus, the detecting member 53 is first detected by the electrophotographic imaging apparatus. During a detecting process, the detecting member 53 can be rotated in one of a first position (an initial position) and a second position (a lifted position) by one or more times. After the detection is completed, the detecting member 53 remains in the first position. When the detecting member 53 is in the first position, the detecting end separation force receiving member 52 is exactly at a position capable of receiving a separating force from a side of the detecting end 22. The separating force separates the developing roller 3 from the photosensitive drum. Since the detecting member 53 is rotatable, the detecting end separation force receiving member 52 provided thereon can also produce a certain degree of rotation when receiving the separating force, which is beneficial to reduce a friction of the detecting end separation force receiving member 52 during a separating process.

Figure 8:
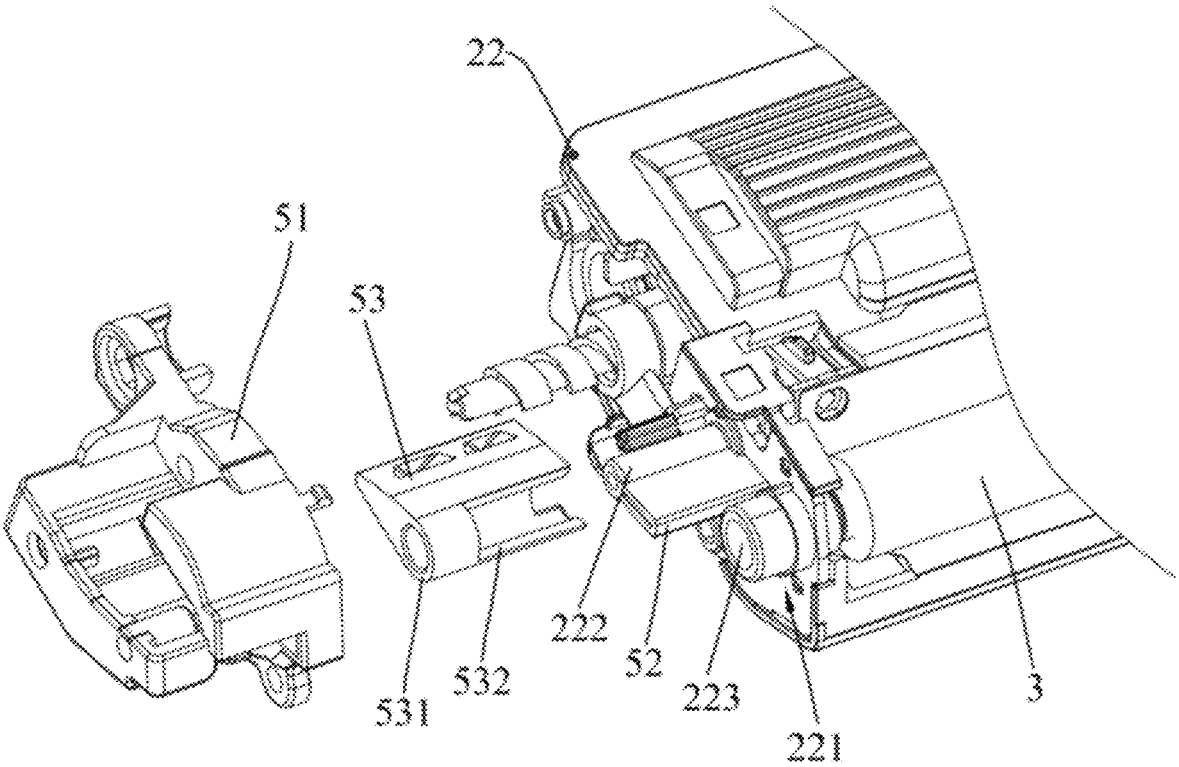
FIG. 8 is a structural exploded view of a second embodiment of a detecting end of a developing cartridge of the present disclosure.

As shown in FIG. 8, in another embodiment of the present disclosure, the detecting end separation force receiving member 52 is directly arranged on the supporting column 222, and is formed integrally with the supporting column 222 or fixedly connected to the supporting column 222. Accordingly, a groove 532 is provided on a rotating shaft 531 of the detecting member 53. A size of the groove 532 in a circumferential direction of the detecting rotating shaft 531 is larger than that of the detecting end separation force receiving member 52, so that the detecting member 53 has a certain rotatable angle and can be rotated between the first position and the second position during the detecting process.

In some embodiments of the present disclosure, the detecting end 22 of the developing cartridge frame 2 is provided with a conductive bracket 221. The conductive bracket 221 includes a developing roller shaft supporting part 223. When the developing cartridge 1 is mounted in the electrophotographic imaging apparatus, the conductive bracket 221 is electrically connected with the photographic imaging apparatus, to provide a developing bias voltage for the developing roller 3. In some embodiments, the support column 222 is arranged on the conductive bracket 221 as shown in FIG. 7 or 8. For example, the support column 222 and the conductive bracket 221 are formed integrally or the support column 222 is fixedly connected with the conductive bracket 221. In some embodiments, it is also possible to reduce an area of a side wall occupied by the conductive bracket 221, the support column 222 is arranged on a sidewall region of the detecting end part 22 that is not occupied by the conductive bracket 221.

In some embodiments of the present disclosure, the detecting end separation force receiving member 52 is extended in a direction of the developing roller 3 on the one hand, and extended in a longitudinal direction of the developing cartridge 1 on the other hand, so as to form a substantially flat shape. A size and a force-receiving area can be made bigger compared to the prior art. In a longitudinal direction of the developing cartridge 1, at least a part of the detecting end separation force receiving member 52 is extended out of the shaft supporting part 223 of the developing roller of the conductive bracket 221.

The developing cartridge 1 of an embodiment of the present disclosure can be assembled with the photosensitive drum cartridge to form a separate-type process cartridge, and then the process cartridge can be mounted in the electrophotographic imaging apparatus. Longitudinal ends of the photosensitive drum cartridge (corresponding to longitudinal ends of the developing cartridge) have separating force transmitting members corresponding to the detecting end separation force receiving member 52 and the driving end separation force receiving member 44, respectively. For example, the separating force transmitting member is rotatably arranged on the longitudinal end of the photosensitive drum cartridge, and transmits the separating force from the electrophotographic imaging apparatus to the detecting end separation force receiving member 52 and the driving end separation force receiving member 44 to change a position of the developing cartridge 1 in the photosensitive drum cartridge is such that the developing roller 3 is separated from the photosensitive drum. The photosensitive drum cartridge has an elastic urging member on a side opposite to the photosensitive drum. The elastic urging member can move the developing cartridge 1 to a contact position of the developing roller 3 and the photosensitive drum in the photosensitive drum cartridge after the separating force of the electrophotographic imaging apparatus is cancelled.

Although the present disclosure is described by the forgoing embodiments, it should be understood that the forgoing embodiments are only used to exemplarily describe the possible embodiments of the present disclosure, and should not be construed as limiting the scope of protection of the present disclosure. Equivalent replacements or changes made by the person skilled in the art in accordance with the present disclosure shall also be covered by the protection scope defined by the claims of the present disclosure.

What is claimed is:

1. A developing cartridge, comprising:

a developing cartridge frame, having an internal space for accommodating a developing agent;

a developing roller, rotatably mounted on the developing cartridge frame, and configured to provide the developing agent for a photosensitive drum;

a drive end cover, mounted on a drive end of the developing cartridge frame; and a drive force receiving member, rotatably mounted at the drive end of the developing cartridge frame;

wherein the drive force receiving member comprises a drive force receiving part that extends out of the drive end cover and is configured to receive a rotational drive force, a driving end separation force receiving member is provided on an outer circumference of the drive force receiving part, and the driving end separation force receiving member is configured to receive a separating force that separates the developing roller from the photosensitive drum.

2. The developing cartridge according to claim 1, wherein the driving end separation force receiving member is provided along an entire outer circumference of the drive force receiving part.

3. The developing cartridge according to claim 1, wherein the driving end separation force receiving member as a whole has a circumferential surface arranged coaxially with the drive force receiving part.

4. The developing cartridge according to claim 1, wherein the driving end separation force receiving member and the drive force receiving part are formed integrally or connected fixedly.

5. The developing cartridge according to claim 1, wherein a detachable or non-detachable snap connection is formed between the drive force receiving part and the driving end separation force receiving member.

6. The developing cartridge according to claim 5, wherein the outer circumference of the drive force receiving part is provided with one or more bayonets, an inner circumference of the driving end separation force receiving member is correspondingly provided with one or more protrusions, and each protrusion is engaged with a corresponding bayonet to realize the snap connection.

7. The developing cartridge according to claim 1, wherein the driving end separation force receiving member is rotatably sleeved on the outer circumference of the drive force receiving part.

8. The developing cartridge according to claim 7, wherein a sliding groove is provided on the outer circumference of the drive force receiving part, a flange is correspondingly provided on an inner circumference of the driving end separation force receiving member, and the flange is rotatably arranged in the sliding groove.

9. The developing cartridge according to claim 8, wherein the drive force receiving part comprises a main body part and a distal end part, wherein the driving end separation force receiving member is sleeved on a step-section of an axial outer end of the main body part, the distal end part is provided in the axial direction of the flange, and the distal end part is fixedly connected with an axial outer end of the main body to form the sliding groove.

10. The developing cartridge according to claim 1, wherein the driving end separation force receiving member is extended out of the drive force receiving part in an axial direction of the drive force receiving member.

11. The developing cartridge according to claim 1, wherein the developing cartridge frame comprises a detecting end, the developing cartridge further comprises a detecting end cover, a detecting member and a detecting end separation force receiving member disposed on the detecting end, the detecting end separation force receiving member is extended out of the detecting end cover toward the developing roller.

12. The developing cartridge according to claim 11, wherein the detecting end is provided with a supporting column, a rotation shaft of the detecting member is rotatably mounted on the supporting column, the detecting end separation force receiving member is arranged on the rotating shaft.

13. The developing cartridge according to claim 11, wherein the detecting end is provided with a supporting column, the detecting end separation force receiving member is directly arranged on the supporting column, and is formed integrally with the supporting column or fixedly connected to the supporting column.

14. The developing cartridge according to claim 13, wherein the detecting end of the developing cartridge frame is provided with a conductive bracket, the support column is arranged on the conductive bracket.

15. The developing cartridge according to claim 14, wherein the conductive bracket comprises a shaft supporting part, in a longitudinal direction of the developing cartridge, at least a part of the detecting end separation force receiving member is extended out of the shaft supporting part.

* * * * *